US008675802B2

(12) United States Patent
Shaban et al.

(10) Patent No.: US 8,675,802 B2
(45) Date of Patent: Mar. 18, 2014

(54) METHOD AND APPARATUS OF DEACTIVATING EXPLOSIVES AND CHEMICAL WARFARE WITH HIGH-ENERGY NEUTRONS GENERATED FROM DEUTERIUM TRITIUM FUSION REACTION

(76) Inventors: Yasser Ragab Shaban, Sofia (BG); Milen K. Panteleev, Concord, CA (US)

( * ) Notice: Subject to any disclaimer, the term of this patent is extended or adjusted under 35 U.S.C. 154(b) by 457 days.

(21) Appl. No.: 13/038,469

(22) Filed: Mar. 2, 2011

(65) Prior Publication Data

US 2013/0202073 A1 Aug. 8, 2013

(51) Int. Cl.
*G21G 1/00* (2006.01)
*G21G 4/02* (2006.01)

(52) U.S. Cl.
USPC ..... 376/114; 250/251; 250/493.1

(58) Field of Classification Search
USPC ..... 376/107, 114, 158; 250/391, 393, 395
See application file for complete search history.

(56) References Cited

U.S. PATENT DOCUMENTS

| | | | | |
|---|---|---|---|---|
| 4,944,211 | A * | 7/1990 | Rowan et al. | 89/8 |
| 5,729,580 | A * | 3/1998 | Millspaugh | 376/114 |
| 6,922,455 | B2 * | 7/2005 | Jurczyk et al. | 376/144 |
| 2006/0014326 | A1 * | 1/2006 | Auburger et al. | 438/123 |
| 2006/0140326 | A1 * | 6/2006 | Rowland et al. | 376/114 |

OTHER PUBLICATIONS

Byungjin Lee and Myunjoo Lee, "Decomposition of 2,4,6-Trinitrotoluene (TNT) by Gamma Irradiation", Environ. Sci. Technol., 2005, 39 (23), pp. 9278-9285.*

* cited by examiner

*Primary Examiner* — Jack W Keith
*Assistant Examiner* — Sean P Burke

(57) ABSTRACT

A non-destructive assay of deactivation of the contents of explosives and chemical warfare on-field (and or in lab) is presented with high-energy neutrons at 14, 4 and 2 MeV. The elements and substances present in the munitions are transmuted into passive elements through neutron-alpha nuclear reactions. Deactivating of the explosives on-field is presented with a unique and compact neutron generator fueled with deuterium gas and tritium breeder. Several high explosives and chemical warfare are presented in the transmutation with physical analysis. The present method and technique can be employed on-field as an improvised explosive device and as a precise explosive device in labs and centers.

4 Claims, 8 Drawing Sheets

FIG. 7

| Nuclear Reaction | Abundant of Isotope % | Microscopic cross section σ (mbarn) | Half-life time |
|---|---|---|---|
| $F^{19}(n, \alpha)N^{16}$ | 100 | 5.7 | 7.4 s |
| $P^{31}(n, \alpha)Al^{28}$ | 100 | 1.3 | 2.3 m |
| $Ge^{74}(n, \alpha)Zn^{71m}$ | 36.74 | 0.02 | 2.2 m |
| $Si^{30}(n, \alpha)Mg^{27}$ | 3.05 | 0.15 | 9.5 m |
| $B^{11}(n,\alpha)N^{8}$ | 81.2 | 0.085 | 0.85 sec |
| $Na^{23}(n, \alpha)F^{20}$ | 100 | 0.55 | 11.2 sec |

S stands for seconds, m for minutes, d for days.

FIG. 8

| Nuclear Reaction | Abundant of Isotope % | Microscopic cross section σ (mbarn) | Half-life time |
|---|---|---|---|
| $F^{19}(n,\alpha)N^{16}$ | 100 | 57 | 7.4 sec |
| $P^{31}(n, \alpha)Al^{28}$ | 100 | 140 | 2.3 min |
| $F^{19}(n,\alpha)N^{16}$ | 100 | 57 | 7.4 sec |
| $Na^{23}(n,\alpha)F^{20}$ | 100 | 220 (30) | 12 sec |
| $Cl^{35}(n,\alpha)P^{32}$ | 75.4 | 100 | 14.3 d |
| $Cl^{37}(n,\alpha)P^{34}$ | 24.6 | 50(190) | 12.5 sec |
| $As^{75}(n,\alpha)Ga^{72}$ | 100 | 29 | NA |

S stands for seconds, m for minutes, d for days.

METHOD AND APPARATUS OF DEACTIVATING EXPLOSIVES AND CHEMICAL WARFARE WITH HIGH-ENERGY NEUTRONS GENERATED FROM DEUTERIUM TRITIUM FUSION REACTION

CROSS-REFERENCE TO RELATED APPLICATIONS

Not applicable

STATEMENT REGARDING FEDERALLY SPONSORED RESEARCH OR DEVELOPMENT

Individual Efforts

BACKGROUND

The HMMWV[1] Laser Ordnance Neutralization System (HLONS), more commonly referred to as ZEUS, was originally developed to defuse land mines through the use of a moderate-power solid state laser and beam control system in order to remotely defuse explosive devices and unexploded ordnance. It is an improvised explosive device (action with a guess) intended to diffuse or to clear surface mines from a distance up to 300 meters as long as it is on line of sight (not hidden). The system uses a 10 kW solid-state heat capacity beam aimed at the target, heating the ordnance to the point of causing the explosive filler to ignite and start to burn. As a result, a low-level explosion is caused and minimal collateral damage obtained. So this technique is considered a destructive assay of neutralization.

[1]http://www.worldlingo.com/ma/enwiki/en/ZEUS-HLONS_(HMMWV_Laser_Ordnance_Neutralization_System).

Prior to the ZEUS-HLONS system, Explosive Ordnance Disposal (EOD) personnel would have to approach such munitions (manually), place an explosive charge near it, and then detonate the charge to destroy the munitions.

BRIEF DESCRIPTION OF DRAWING AND TABLES

Figures and tables included in this invention are briefly described as follows.

FIG. 1 illustrates the main mechanisms of primary and secondary transmutations involved in nuclear reactions.

FIG. 2 explores the main elements of the neutrons generator. The diagram shows the elements of the neutrons generator in three dimensions.

FIG. 7 Table 1 lists the candidate threshold neutron energy at 4 MeV.

FIG. 8 Table 2 lists the candidate threshold neutron energy at 14 MeV.

SUMMARY OF THE INVENTION

One embodiment of the present invention is the unique structure of the fast neutrons generator, a unique ionizing source of deuterium with platinum mesh a free-energy source, a unique composed structure of tritium breeder.

Second embodiment is the non-destructive assay of neutralization of explosives and chemical warfare on-field and controlled areas with the present neutrons generator.

Third embodiment includes the proposal of neutralization of explosives and chemical warfare with the use of fast neutrons emitted from the neutrons generator (primary transmutation).

Fourth embodiment is the neutralization of explosives and chemical warfare with the use of fast neutrons emitted inside the explosives (secondary transmutation).

Figure 2:
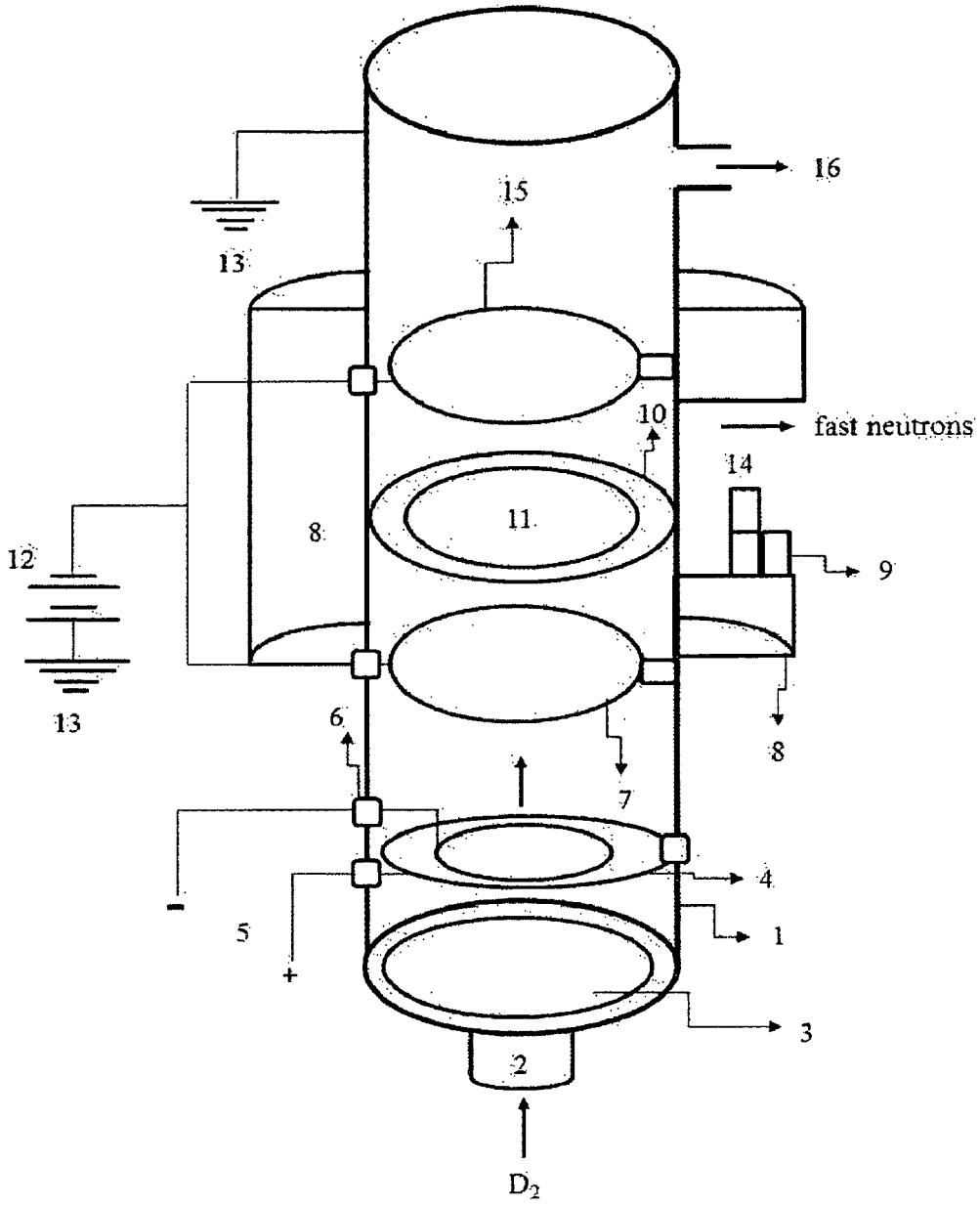

The neutrons generator comprises the following elements as indicated by their numbers in FIG. 2: a vacuum chamber (1) with grounding connection (13), a gas entry element (2), an exit element (16) to vacuum system, an element (3) of ionizing deuterium gas with electrochemical apparatus porous or mesh that has greater standard electrode reduction-potential than hydrogen and its isotopes (chosen platinum), a coaxial rings elements (4) to separate the positive ions from the negative ions with dc voltage supplied by an external high-current power supply (5), an element (6) made of ceramic to isolate the electric connections from the chamber, an element (6) is also used to support the inner elements with the chamber wall, an element (7) which is the first accelerating grid configured cylindrically (with opening spaces) to energize the positive fusion deuterium ions to kilovolt energies, an element (10) is a lithium blanket which is the first part of the tritium breeder, an element (11) is a lithium mesh enriched with platinum precursors which is the second part of the tritium breeder placed at the center of element (10), an element (15) which is the second accelerating grid configured cylindrically (with opening spaces) to energize the positive tritium ions to kilovolt energies, an external high-voltage dc power supply (12) which feeds elements 7 and 15, an element (8) is a chopped neutron reflector that has a bare area (14), an element 9 is a polyethylene sheets occupies half of the space (14).

DETAILED DESCRIPTION OF THE INVENTION

I) The Concept

Figure 1:
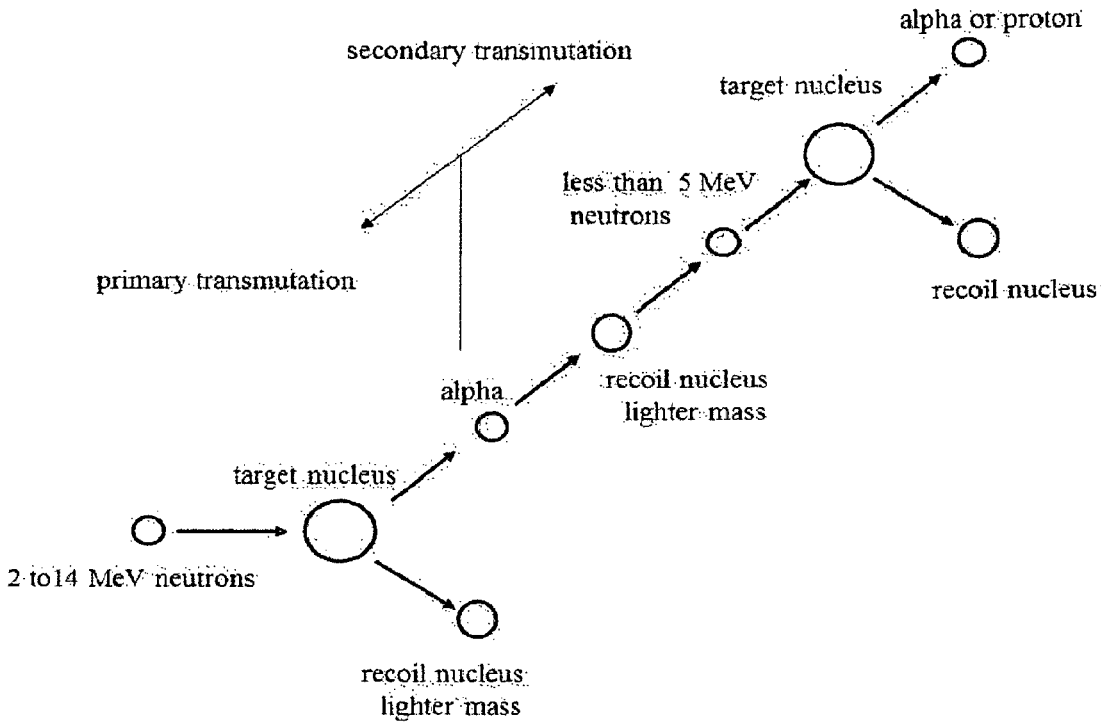

A non-destructive assay of deactivation (transmutation) of the contents of explosives and chemical warfare on-field (and or in lab) is presented with high-energy neutrons greater than 2 MeV. The elements being transmuted must undergo neutron alpha nuclear reaction abbreviated; (n,α). (Neutron proton nuclear reactions are not desirable in chemical transmutation since the recoil nuclide decays back to the original nucleus with a short half-life from few seconds to few days. Two levels of deactivations or transmutation will take place as a result of neutrons bombardment: primary and secondary as shown in FIG. 1.

In the primary deactivation, the munition is irradiated by the energetic neutrons. The attenuated and transmitted neutrons therefore induce nuclear reactions with the target isotopes of the elements of the explosives. The isotopes of the elements or substances of the explosives lose 4 amu (atomic mass unit) in a single collision, consequently, the bombarded isotopes disintegrates from higher to lower mass, a new element. As a result, the chemical compositions will be changed from critical to subcritical, additionally; the reactive elements will be transformed into passive elements.

In the secondary transmutation, the emitted alpha particles a from the primary reactions would have great tendency to generate neutrons via (α, n) as a result of hitting light targets or nuclides. The secondary neutrons eventually hit new target nuclei for further transmutation, and so on.

Deactivations of the explosives can be performed with high precision but this requires a prior knowledge of the contents of the elements. Otherwise, for improvised deactivation, the neutrons energy and the irradiation time will be chosen arbitrary.

Deactivating the explosives on-field in a short period requires the presence of strong neutron source of high energy. Deuterium and tritium fusion reaction is the only candidate. (Particle accelerators are not considered a portable device.) However tritium is an expensive substance and is restricted to certain applications and applicants. Moreover, it requires complicated regulations that may discourage its uses for vital applications such as the present one. Hence the present neutron generator includes a tritium breeder that is produced and used during the operation of the generator.

The present method and technique can be employed on-field as an improvised explosive device and as a precise explosive device in labs and centers. Even though it is recommended to get the neutron generator as near as possible to the munitions so to maintain high neutron flux, the generator would be structured on robot or unmanned vehicle. So the feature of the classical improvised explosive device such as ZEUS system that can be used from several meters to hundreds of meters is not a real advantage. In addition, the features of the present invention are that, it can be used to neutralize hidden munitions whereas ZEUS system is operating for surface munitions. Finally, the present invention neutralizes the explosives in a non-destructive assay whereas for ZEUS system the neutralization still belongs to the destructive assay.

II) The Neutron Generator

The neutron generator produces two types of neutrons: primary and secondary neutrons. The primary neutrons are produced through selected fusion reaction that is used to ignite other type of fusion reaction, leading to the generation of high-energy neutrons (termed secondary neutrons).

The high-energy neutrons are produced by the D-T (deuterium-tritium) fusion reaction. D-T fusion neutron source is the best candidate to deactivate the explosives on-field, Reaction 1.1. It produces the most energetic neutrons 14.1 MeV kinetic energy and is the easiest fusion reaction to ignite, it generates almost 100 times neutron rate more than any other fusion reaction under the same conditions.

deuterium+tritium→alpha (3.5 MeV)+neutron (14.1 MeV). 1.1

Hydrogen-2 (Deuterium) is a naturally occurring isotope of hydrogen and as such is universally available.

Hydrogen-3 (Tritium) is a rare isotope of hydrogen; it occurs naturally in only negligible amounts due to its radioactive half-life of 12.32 years. In order to proceed with the fusion reaction 1.1, the deuterium-tritium fuel cycle requires the breeding of tritium from lithium. Tritium is produced inside the neutron generator by neutron activation of lithium-6 (7.5% abundance), Reaction 2:

neutron+lithium-6→tritium (2.75 MeV)+alpha (2.05 MeV). 1.2

Reaction 1.2 is an exothermic reaction yielding 4.8 MeV and thus neutrons of any energy can be employed. High-energy neutrons can also produce tritium from lithium-7 (92.5% abundance) in an endothermic reaction, consuming 2.466 MeV, Reaction 1.3:

neutron+lithium-7→tritium+alpha+neutron. 1.3

The reaction with Lithium-6 is exothermic, providing a small energy gain for the neutron generator. The reaction with Lithium-7 is endothermic but does not consume neutrons in the overall reaction. The present invention includes the use of naturally occurring mix of lithium isotopes.

The reactant neutrons in the tritium breeder reactions (1.2&1.3) are supplied by the D-D fusion reactions of which neutrons 2.45 MeV are released (primary neutrons):

deuterium+deuterium→helium-3 (0.82 MeV)+neutron (2.45 MeV), 1.4 deuterium+deuterium→tritium (1.01 MeV)+proton (3.02 MeV). 1.5

FIG. 2 outlines the main components of the neutron generator. The inner components of the neutron generator are vacuum cylinder (1), platinum grid (3), dc rings (4), first accelerating grid (7), lithium mesh enriched with platinum precursors (11), a lithium blanket (10) surrounds element 11, and second accelerating gird (15). The outer components are the neutron reflector (8) that has bare region (14), three sheets of polyethylene for low moderation (9), low-voltage dc power supply (5), a high-voltage dc power supply (12), a vacuum pump connected to element 16. The accelerating grids are negatively biased while the cylinder wall is positively biased since it is grounded. Element 6 is a ceramic that is used for double purposes; for electric isolation and for the support of the inner elements to the chamber (1).

Figure 3:
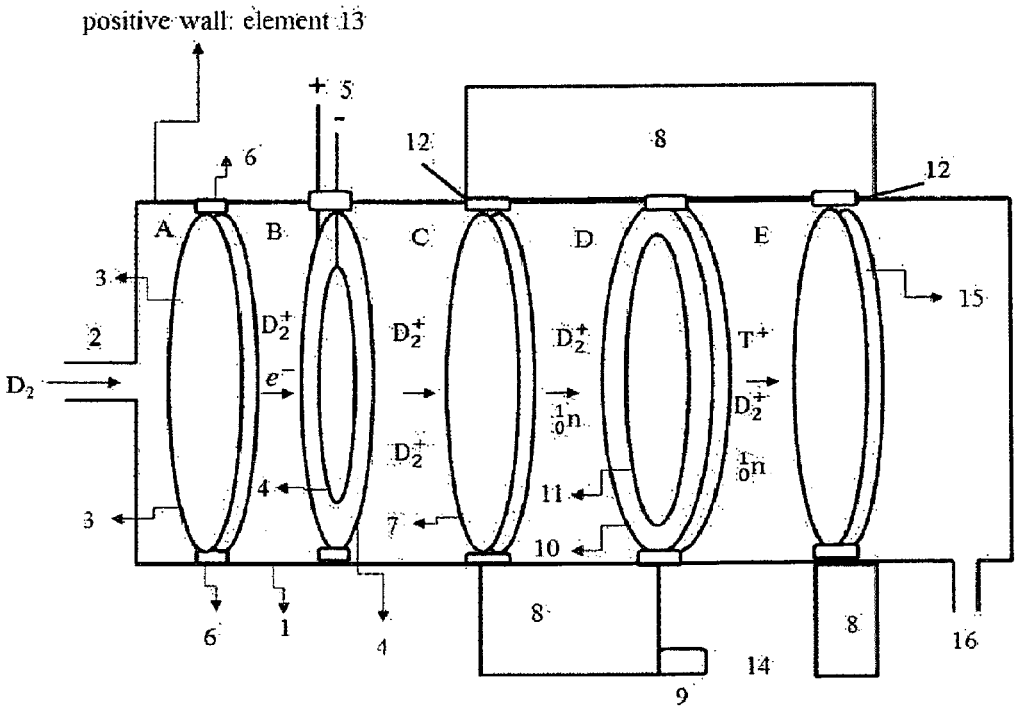
FIG. 3 is the plane-view of the neutrons generator. It shows the physical regions of the neutron generator.

Five main regions characterize the neutron generator as shown in FIG. 3. The first region (denoted A in the diagram) is a neutral of gaseous deuterium molecules located between the entry and the platinum grid (3). Once the deuterium molecules $D_2$ pass through the platinum grid (mesh) it will be ionized according to the oxidation electrochemical reaction:

deuterium→electron+deuterium ion. 1.6

The standard reduction electrode potential for platinum is 1.2 V and for hydrogen (isotope of deuterium) is 0.0 V. According to electrochemistry platinum is reduced and hydrogen molecule is oxidized as shown in reaction 1.6 for deuterium. Hence region B consists of deuterium positive ions, electrons, and some neutral molecules. The third region, region C, is divided into regime of positive ions located at the center and vicinity and a regime of negative particles located at the outer of the negative ring (the inner ring). The deuterium positive ions and electrons are segregated by applying a dc voltage onto double coaxial rings (4). The electrons are guided by the outer positive ring and deuterium $D_2$ positive ions are guided by the inner negative ring. The applied dc voltage in this region is on the order of 20 volts. The positive deuterium ions will be then subject to acceleration (7) by a high dc voltage (12) in the range of 50 to 70 kV supplied by an external power supply. Within the gird openings the deuterium ions fuse and generate neutrons according to reaction 1.4 and produce protons and short living tritium according to reaction 1.5. So the fourth region, region D, composes neutrons and unburned deuterium ions. The generated neutrons from the first grid hence interact with the lithium blanket (10) and the lithium mesh enriched with platinum (11), as a result; tritium is produced and ionized via reaction 1.6. The reason we apply a lithium mesh is to allow the tritium ions move through the openings toward the second accelerating grid (15). The fifth region, region E, includes tritium positive ions, neutrons from the first fusion reactions and unburned deuterium ions. The tritium and deuterium ions undergo fusion reaction in the second accelerating grid which is biased by a negative potential (12) equal to or slightly greater than the potential of the first accelerating grid.

Figure 4:
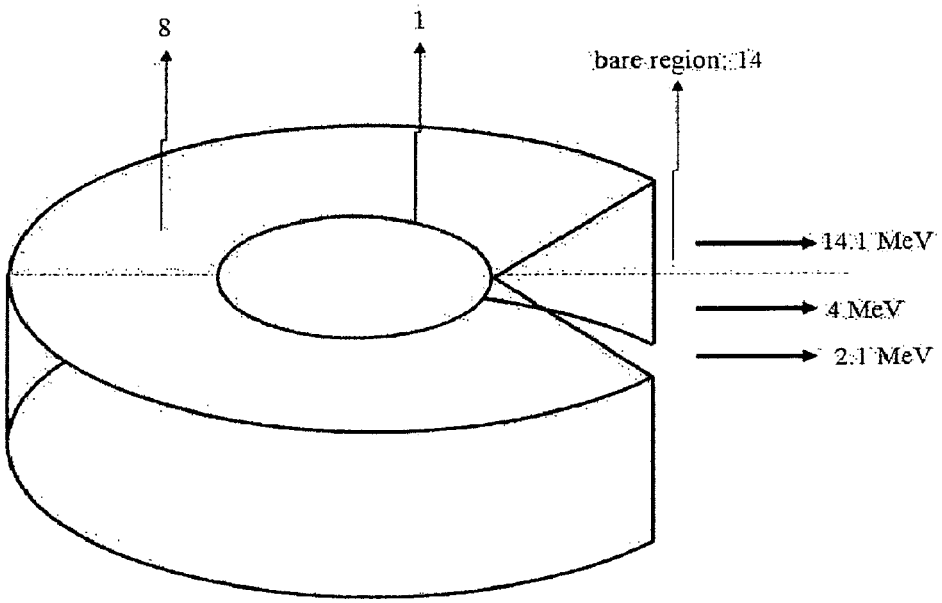
FIG. 4 is the geometric shape of the neutrons reflector.
Figure 5:
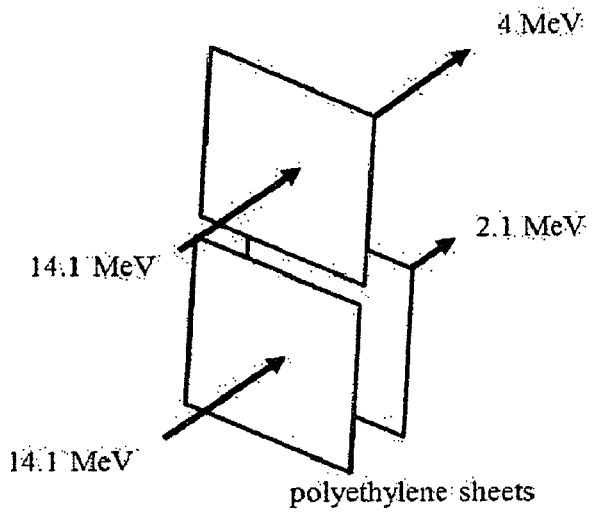
FIG. 5 shows the multilayer of the neutrons moderator.

The characteristic of the neutron reflector (8) is shown in FIG. 4. A part of the neutron reflector is chopped (14), without reflecting material. The chopped part is the exit of the neutrons generator. One-half of the chopped part is void of which the 14.1-MeV neutrons exit the generator. The other half of the chopped area is occupied with three polyethylene sheets (9); two sheets are oriented at the bottom part and one sheet is placed at the top part as shown in FIG. 5. The 4-MeV neutrons will exit from the double-sheet area and the 2-MeV neutrons will exit from the single sheet area.

III) The Analysis of Transmutation

A precise deactivation requires a prior knowledge of the contents of the munitions and their concentrations. On the other hand, an improvised deactivation can be made without the knowledge of the contents of the explosives.

Deactivation of chemical warfare CW and high explosives HE take place under threshold nuclear reactions. Such nuclear reactions force the reactive chemical constituents of the CW and HE to go into inactive state. This happens when the targets are bombarded with high energy neutrons above the threshold energy of each nuclear reaction by the elements of interest.

The threshold energy of the nuclear reactions is a function of the so-called Q-value. The Q value is defined as $$Q=c^2\times(\text{masses of the reactants}-\text{masses of the products}). \quad 1$$

Where c is the speed of light and m is the mass in amu, using the conversion factor 931 MeV/(amu.$c^2$), then:

$$Q(\text{MeV})=931\times(\text{masses of the reactants}-\text{masses of the products}). \quad 2$$

If Q is positive, that is the total of the reactant masses is greater than the total of the product masses), then the nuclear reaction is exothermic and no threshold energy is needed for neutrons. In this case, the nuclear reaction takes place with thermal energy ~eV. Conversely, if Q is negative, then the nuclear reaction is endothermic. The nuclear reaction takes place with energetic neutrons; the minimum neutron energy required to induce a nuclear reaction is called the threshold energy. However, the threshold energy Et is somewhat greater than the Q value since a part of the energy is needed for the recoil of the compound nucleus $$Et=-Q(\text{MeV})\times(m+M)/M. \quad 3$$

Where: m and M are the masses of the incident particle and the target nucleus respectively. Threshold energy given by equation 3 leads to a specific value, however, practically speaking threshold energies vary widely for one nuclear reaction depending on the microscopic cross section. A chosen nuclear reaction occurs at different neutron energies but it has a maximum value at certain neutron energy. In general, the higher is the incident neutron's energy, the larger is the microscopic cross section, denoted σ. For this reason, the threshold neutron energy is usually evaluated experimentally. Nuclear reactions at different neutron energies (experimental values) are tabulated in Tables 1 and 2.

The rate of which the target nucleus is converted into another nucleus is evaluated from the following relation $$R=N\times\sigma\times\phi i\times V. \quad 4$$

Where: R is the transformation rate (isotopes/sec), σ is the microscopic cross section ($cm^2$), ϕi is the neutron flux (# of neutrons/$cm^2$.sec), V is the volume of the contents in $cm^3$, N is the isotopic density (isotopes/$cm^3$), given by $$N=(0.6023\times E24(\text{atoms/mole})\times f\times\epsilon)/Ma. \quad 5$$

Where: E24 refers to the arithmetic function ten to the power 24, f is the density (grams/$cm^3$), ϵ is the isotope abundance (%), and Ma is the atomic weight (grams/mole).

The neutron flux ϕi is the sum of the uncollided neutrons and the collided neutrons within the shell or the container of the explosives.

$$\phi i=\phi u+\phi c. \quad 6$$

The uncollided flux ϕu is given by $$\phi u=(S/A)\times(\text{Exp}-\Sigma t(Ei)\times\delta). \quad 7$$

Where: Exp refers to the athematic exponent, S is the neutron rate (# of neutrons/sec) measured from the exit of the neutron generator, A is the geometric area, Σt is the total macroscopic cross section (1/cm) of the container, Ei is the initial neutron energy before collision, and δ is the thickness of the container. The area A is evaluated from FIG. 6 and is given by $$A=(1/2)\times r\times(h+H). \quad 8$$

Where: r is the distance between the neutron source and the target, h is the thickness of the neutron core (inside the generator) which is equal to thickness of the accelerating grid, and H is the height or the diameter of the target. The geometry of the explosive differs from one type to another but the geometric remains constant since it depends on h, r, and H.

Figure 6:
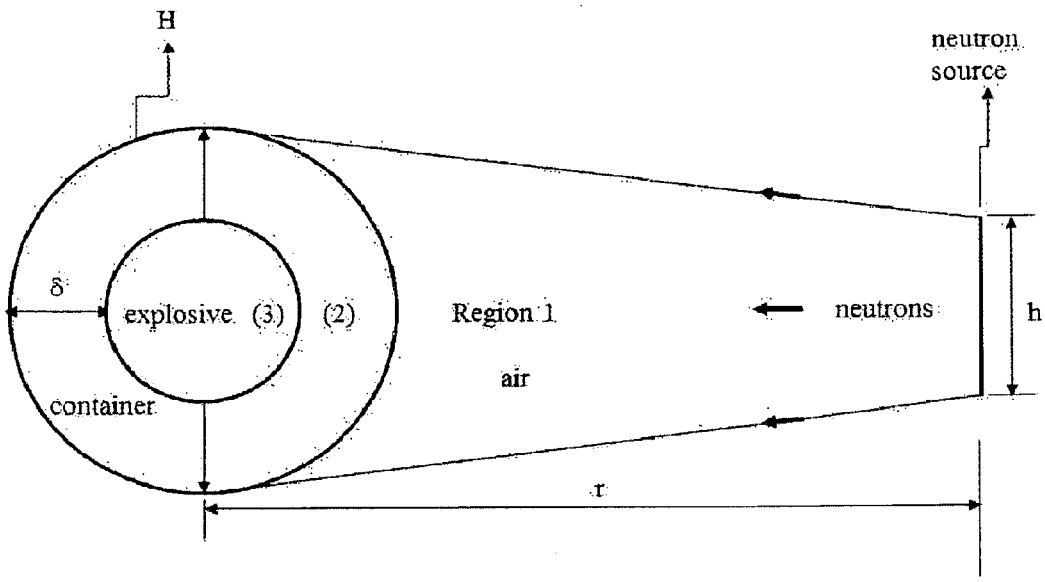
FIG. 6 is the setup configuration of evaluating the neutron flux at the target from a line neutron source of height h.

The collided neutrons ϕc is given by $$\phi c=S\times(Pr/A). \quad 9$$

Where S, Pr and A are the neutron source rate, the probability of the collision within the shell of the container, and A is the area respectively. As shown in FIG. 6, there are three different regions. Region (1) is a void region, air, representing the distance from neutron generator to the location of explosive. Region (2) indicates to the presence of the container (shell) of the explosives. Region (3) indicates to the presence of the substances of explosives. The probability Pr for neutrons to suffer a scattering collision in region (2) from Ei to Ef is given by $$Pr=(\Sigma s(Ei\rightarrow Ef)dEf)/\Sigma t(E). \quad 10$$

Where: Σs(Ei→Ef)) is the macroscopic differential scattering cross section, it is given by $$\Sigma s(Ei\rightarrow Ef)=\Sigma s(Ei)\times P(Ei\rightarrow Ef). \quad 11$$

Where: P(Ei→Ef) is the probability of scattering, and P(Ei→Ef) dEf is the probability that a neutron of energy $E_i$ will emerge from scattering with energy in the interval $E_f$ to $E_f+dE_f$. For when $\alpha E_i<E_f<E_i$, then $$P(Ei\rightarrow Ef)dEf=1/(Ei(1-\alpha)), \quad 12$$

otherwise;

$$P(Ei\rightarrow Ef)dEf=0. \quad 13$$

Where: $\alpha=((M-1)/(M+1))^2$ and M is the mass of the scatter. It is assumed that the scattering is elastic and isotropic in the center of mass system. To make the present analysis quite realistic, it is a good approximation to replace the actual scattering by isotropic scattering if at the same time the total cross section Σt is replaced by the transport cross section Σtr. Therefore the probability Pr for the neutrons to suffer a scattering collision in region (2) is equal to $$Pr=(\Sigma s(Ei)dEf)/(\Sigma tr(Ei)\times Ei\times(1-\alpha). \quad 14$$

For mono-energetic neutrons which is the case for the present neutron generator and by considering that Ef is slightly less than Ei then Equation 14 becomes $$Pr=\Sigma s/(\Sigma tr(1-\alpha)). \quad 15$$

Substitute Equation 15 into Equation 9, hence $$\phi c=(S/A)\times(\Sigma s)/(\Sigma tr(1-\alpha)). \quad 16$$

Substitute Equations 16 and 7 into Equation 6, then the total neutron flux $\phi i$ is equal to $$\phi i=(S/A)\times(\mathrm{Exp}(-\Sigma t(Ei)\times\delta)+\Sigma s/(\Sigma tr(1-\alpha))). \quad 17$$

Therefore the transmutation rate R is equal to $$R=N\times\sigma\times V\times(S/A)\times(\mathrm{Exp}(-\Sigma t(Ei)\times\delta)+\Sigma s/(\Sigma tr(1-\alpha))). \quad 18$$

Charged particles are generated as a result of the irradiation of the target-nucleus with high neutron energies in most nuclear reactions. (Our interest in the present is the emissions of alpha particles, even though protons are emitted in nuclear reactions.) However, some nuclear reactions occur at thermal energy such as: boron-10+neutron→alpha+lithium-7. Nuclear reaction is the instantaneous break of the target nucleus into alpha and recoil nucleus as a result of neutrons bombardments at high energy such that the recoil nucleus is left in excited state. The excited nucleus (the product) therefore decays by the emissions of beta or gamma radiations in very short half-life time compared to radioactive decay of heavy nucleus which may runs to years. The essence of the nuclear transmutations is the break of the target nucleus and not the decay of the product (recoil) nucleus. The duration of the neutrons irradiation depends on the masses of the substances of explosives.

IV) Deactivation of Explosives: Primary Transmutation

Both HE and CW agents used in munitions are organic chemical chemicals, rich in carbon, oxygen, and hydrogen. The However, each CW agent contains one or more of the elements chlorine, fluorine, sulfur, or phosphorus in unique combinations. Even though chemical substances are composed of molecules, neutrons are interacting with the isotopes of substances.

1) TNT

To deactivate the TNT ($N_2$, $H_2$, $O_2$, C), nitrogen and oxygen are selected to be transmuted into passive elements since the transformations of nitrogen and oxygen involve the emission of alpha particles $_2{}^4He$. The reason we deactivate $N_2$ because $N_2$ and $H_2$ interact chemically forming ammonia $NH_3$ and release energy 46.1 kJ/mole ($N_2+3H_2\rightarrow 2NH_3$). The transmutation of oxygen is performed with neutrons at 4 MeV as follows neutron+oxygen-16→carbon-13+alpha. 1.7

The deactivation of $N_2$ is performed by bombarding the TNT with 2.1 MeV neutrons. So the deactivation of nitrogen-14 (99.636%) is transmuted as follows neutron+nitrogen-14→boron-11+alpha. 1.8

Hydrogen and graphite (carbon) are chemically reactive (exothermic): $C+2H_2\rightarrow CH_4$, the energy release is 75 kJ/mole. However the TNT is in a subcritical state; it contains boron-11, carbon-13, carbon-12, hydrogen and the remaining of unconverted oxygen-16 and nitrogen-14.

2) Sarin GB

Deactivation of Sarin GB ($F_2$, $H_2$, $O_2$, C, P) is performed with the transmutation of Fluorine, oxygen and phosphorus. The transmutation of oxygen is performed with neutrons at 4 MeV, reaction 1.7. The transmutation of phosphorus is performed with neutrons at 14 MeV neutron+phosphorus-31→aluminum-28+alpha. 1.9

The transmutation of fluorine is performed with neutrons at 14 MeV neutron+fluorine-19→nitrogen-16+alpha. 1.10

However, nitrogen-16 is a metastable, it emits beta and decays to oxygen-16 in half-life time 7.4 seconds, and then it decays to carbon-12 with the emission of alpha particles $\alpha$. The Sarin GB agent is in a subcritical state; it contains nitrogen-16, aluminium-28, carbon-13, hydrogen, carbon-12, and the unconverted fluorine-19 and phosphorus-31.

3) VX

Deactivation of the agent VX (S, $N_2$, $O_2$, C, P, $H_2$) is performed with the transmutation of sulfur, nitrogen, oxygen, and phosphorus. The transmutation of oxygen is performed with neutrons at 4 MeV, reaction 1.7. The transmutation of nitrogen is performed with 2.1 MeV neutrons, reaction 1.8. The transmutation of phosphorus is performed with neutrons at 14 MeV, reaction 1.9. The transmutation of sulfur is performed with neutrons at 2.1 MeV:

neutron+sulfur-32→silicon-29+alpha. 1.11

The possibility of forming the nuclear reaction: sulfur-32 (neutron, proton) phosphorus-32 at 2.1 MeV exists but the radioactive nuclide phosphorus-32 has a half-life time 15.4 days; it decays to sulfur-32 with the emission of electrons. At this stage, VX is placed in a subcritical state. The agent VX after transmutation contains carbon-13, boron-11, aluminum-28, silicon-29, hydrogen, and carbon-12.

4) Lewisite

Deactivation the agent Lewisite ($H_2$, $Cl_2$, As, C) is performed with the transmutation of chloride element (or chlorine gas) and arsenic. The transmutation of chloride or chlorine $Cl_2$ is performed with neutrons at 14 MeV neutron+chlorine-35→phosphorus-32+alpha. 1.12

Similar to the agent VX, phosphorus-32 decays to sulfur-32 with the emission of electrons. The transmutation of arsenic-75 ($^{75}$As 100% abundant) with neutrons at 14 MeV neutron+arsenic-75→gallium-72+alpha. 1.13

After transmutation, Lewisite is placed in deactivation mode since it contains phosphorus-32 (and its decay sulfur-32), gallium-72, carbon-12, and hydrogen.

5) Mustard

Deactivation of the Mustard agent ($H_2$, $Cl_2$, S, C) is taking place when Chloride and sulfur are transmuted at neutrons energy 14 MeV and 2.1 MeV respectively. Chloride is strong oxidant and thus its transmutation reduces the risk of the Mustard. The transmutation of chloride or chlorine $Cl_2$ is performed neutrons energy 14 MeV, reaction 1.12. The transmutation of sulfur is performed at 2.1 MeV, reaction 1.11.

6) VX Land Mines

VX land mine contains phosphorus and sulfur; phosphorus-31 and sulfur-32. The deactivation is processed by reactions 1.9 and 1.11.

7) GB

GB contains phosphorus and fluorine: phosphorus-31 and fluorine-19. Their deactivations are given by reactions 1.9 and 1.10 respectively.

8) Comp. B

Comp. B contains oxygen and nitrogen. Their deactivations are given by reactions 1.7 and 1.8 respectively.

V) Deactivation of Explosives: Secondary Transmutation

The generated alpha particles form reactions 1-7 to 1.13 have a great tendency to induce neutrons via interaction with light elements present in the munitions, theseare forexample:

brellium-9+alpha→carbon-12+neutron+($Q$=5.69 MeV), 1.14 boron-11+alpha→nitrogen-14+neutron+($Q$=0.157 MeV). 1.15

The emitted neutrons therefore induce further transmutation via reactions 1.7 to 1.13 but not the 14-MeV reactions since the generated neutrons would have energy less than 5 MeV.

However, the primary transmutation remains the main mechanism of neutralizing CW and HE. In principle, the generated alpha particles form reactions 1-7 to 1.13 and from Tables 1 and 2 induce further transmutation according to its course of its interaction with matter.

TABLE 1

| Nuclear Reaction | Abundant of Isotope % | Microscopic cross section σ (mbarn) | Half-life time |
|---|---|---|---|
| $F^{19}(n,\alpha)N^{16}$ | 100 | 5.7 | 7.4 s |
| $P^{31}(n,\alpha)Al^{28}$ | 100 | 1.3 | 2.3 m |
| $Ge^{74}(n,\alpha)Zn^{71m}$ | 36.74 | 0.02 | 2.2 m |
| $Si^{30}(n,\alpha)Mg^{27}$ | 3.05 | 0.15 | 9.5 m |
| $B^{11}(n,\alpha)N^{8}$ | 81.2 | 0.085 | 0.85 sec |
| $Na^{23}(n,\alpha)F^{20}$ | 100 | 0.55 | 11.2 sec |

S stands for seconds,
m for minutes,
d for days

TABLE 2

| Nuclear Reaction | Abundant of Isotope % | Microscopic cross section σ (mbarn) | Half-life time |
|---|---|---|---|
| $F^{19}(n,\alpha)N^{16}$ | 100 | 57 | 7.4 sec |
| $P^{31}(n,\alpha)Al^{28}$ | 100 | 140 | 2.3 min |
| $F^{19}(n,\alpha)N^{16}$ | 100 | 57 | 7.4 sec |
| $Na^{23}(n,\alpha)F^{20}$ | 100 | 220 (30) | 12 sec |
| $Cl^{35}(n,\alpha)P^{32}$ | 75.4 | 100 | 14.3 d |
| $Cl^{37}(n,\alpha)P^{34}$ | 24.6 | 50 (190) | 12.5 sec |
| $As^{75}(n,\alpha)Ga^{72}$ | 100 | 29 | NA |

S stands for seconds,
m for minutes,
d for days.

What is claimed is:

1. A method for neutralizing a weapon containing a chemical payload using a neutron generator, wherein the neutron generator comprises:

a low-voltage power source;

a high-voltage power source;

a vacuum pump;

a positively-biased cylindrical vacuum chamber, operatively connected to the vacuum pump, the vacuum chamber containing:

a fuel source;

a platinum grid;

a concentric pair of do rings operatively connected to the low-voltage power source;

a first negatively-biased accelerating grid operatively connected to the high voltage source;

a platinum enriched lithium mesh;

a lithium blanket surrounding the lithium mesh;

a second negatively-biased accelerating grid operatively connected to the high voltage source;

wherein the vacuum chamber is surrounded by a neutron reflector, except for a bare region which comprises: a region with two polyethylene sheets; a region with one polyethylene sheet; and a region with no polyethylene sheets;

the method comprising:

locating a chemical weapon;

generating a moderated neutron beam with the neutron generator; and targeting the chemical weapon with the moderated neutron beam for a period of time.

2. The method of claim 1, wherein the period of time is calculated based upon measurements of the chemical payload.

3. A method for neutralizing a weapon containing a chemical explosive using a neutron generator, wherein the neutron generator comprises:

a low-voltage power source;

a high-voltage power source;

a vacuum pump;

a positively-biased cylindrical vacuum chamber, operatively connected to the vacuum pump, the vacuum chamber containing:

a fuel source;

a platinum grid;

a concentric pair of dc rings operatively connected to the low-voltage power source;

a first negatively-biased accelerating grid operatively connected to the high voltage source;

a platinum enriched lithium mesh;

a lithium blanket surrounding the lithium mesh;

a second negatively-biased accelerating grid operatively connected to the high voltage source;

wherein the vacuum chamber is surrounded by a neutron reflector, except for a bare region which comprises: a region with two polyethylene sheets; a region with one polyethylene sheet; and a region with no polyethylene sheets;

the method comprising:

locating a chemical explosive;

generating a moderated neutron beam with the neutron generator; and targeting the chemical explosive with the moderated neutron beam for a period of time.

4. The method of claim 3, wherein the period of time is calculated based upon measurements of the chemical explosive.

* * * * *